US005678142A

United States Patent [19]

Saegusa

[11] Patent Number: 5,678,142

[45] Date of Patent: Oct. 14, 1997

[54] IMAGE FORMING APPARATUS HAVING SIMULTANEOUS DEVELOPING/CLEANING AND RESIDUAL TONER CONTACT CHARGING DEVICE

[75] Inventor: Hisayoshi Saegusa, Hino, Japan

[73] Assignee: Kabushiki Kaisha TEC, Shizuoka, Japan

[21] Appl. No.: 551,401

[22] Filed: Nov. 1, 1995

[30] Foreign Application Priority Data

| | | | |
|---|---|---|---|
| Nov. 8, 1994 | [JP] | Japan | 6-273988 |
| Sep. 21, 1995 | [JP] | Japan | 7-243391 |

[51] Int. Cl.[6] ..... G03G 21/00

[52] U.S. Cl. ..... 399/129; 399/150

[58] Field of Search ..... 355/269, 270, 355/219; 399/129, 149, 150

[56] References Cited

U.S. PATENT DOCUMENTS

| | | | |
|---|---|---|---|
| 4,616,918 | 10/1986 | Kohyama et al. . | |
| 5,066,982 | 11/1991 | Hosoya et al. | 355/269 |
| 5,187,525 | 2/1993 | Fushimi et al. | 355/269 |
| 5,196,892 | 3/1993 | Mitsuaki | 355/269 |
| 5,221,946 | 6/1993 | Kohyama | 355/270 |
| 5,321,471 | 6/1994 | Ito et al. | 355/219 |
| 5,323,215 | 6/1994 | Ohtaka et al. | 355/269 |
| 5,333,041 | 7/1994 | Ito et al. | 355/270 |
| 5,438,397 | 8/1995 | Okano et al. | 355/269 |

FOREIGN PATENT DOCUMENTS

| | | |
|---|---|---|
| 0 390 599 | 10/1990 | European Pat. Off. . |
| 0 459 607 | 12/1991 | European Pat. Off. . |
| 0 459 607 A2 | 12/1991 | European Pat. Off. . |
| 0 538 740 | 4/1993 | European Pat. Off. . |
| 0 540 341 | 5/1993 | European Pat. Off. . |
| 3-127086 | 5/1991 | Japan . |
| 4-34566 | 2/1992 | Japan . |
| 4-83284 | 3/1992 | Japan . |
| 4-310980 | 11/1992 | Japan . |

OTHER PUBLICATIONS

"Japan Hardcopy 1991" A collection of papers, pp. 29–32 (1991); Measurement on the Charging of a One–Component Toner with the Use of Laser Doppler Method.

*Primary Examiner*—Robert Beatty

*Attorney, Agent, or Firm*—Frishauf, Holtz, Goodman, Langer & Chick

[57] ABSTRACT

An image forming apparatus comprises a contact charging member for contacting a photosensitive drum and charging it with electricity, an exposer for exposing the charged photosensitive drum to light and forming an electrostatic latent image thereon, a developing device for visualizing the electrostatic latent image formed on the photosensitive drum by means of coloring powder, a transferring device for transferring the image visualized by the developing device onto a recording medium and a deelectrifier for deelectrifying the photosensitive drum after transferring the image by the transferring device. Any residual coloring powder remaining on the surface of the photosensitive drum after transfer is collected and cleaned by the developing device simultaneously with the developing operation. A coloring powder contact charging member is arranged between the contact charging member and the transferring device and is designed to be held in contact with the residual coloring powder remaining on the surface of the photosensitive drum in order to charge the coloring powder with a voltage higher than a discharge-triggering voltage to a polarity the same as that of the electric charge of the contact charging member.

15 Claims, 4 Drawing Sheets

IMAGE FORMING APPARATUS HAVING SIMULTANEOUS DEVELOPING/CLEANING AND RESIDUAL TONER CONTACT CHARGING DEVICE

BACKGROUND OF THE INVENTION

1. Field of the Invention

This invention relates to an image forming apparatus for producing images, using the process of electronic photography.

2. Description of the Related Art

Known image forming apparatuses involving a so-called cleanerless process of simultaneously carrying out an image developing operation and a cleaning operation in a single developing device include one disclosed in Japanese Patent Publication No. 3-127086. The known apparatus comprises an electrostatic latent image carrier realized by arranging a corona charger, an exposer for exposure to light, a developing vessel, a corona transferrer, a plurality of memory erasing brushes and a deelectrifier arranged in the recited order around a photosensitive drum. After evenly charging the photosensitive drum with electricity, it is exposed to the exposer to form an electrostatic latent image, which is developed by means of a toner of coloring powder to produce a visible image in the developing vessel and the visible image is then transferred to a recording medium that may be a sheet of ordinary paper by means of the transferrer.

The electrostatic latent image carrier may be an insulator drum or a semiconductor drum.

As a result of each operation cycle as described above, the residual toner remaining on the photosensitive drum may spread over the entire surface of the photosensitive drum after the image transferring step to produce a distribution pattern of the residual toner on the surface even if the drum is deelectrified by the deelectrifier to eliminate any electric potential difference on the surface of the drum regardless of the image carrying area and the non-image carrying area of the surface. Thus, a plurality of memory erasing brushes are applied to ensure an even distribution of the residual toner.

With the above arrangement, the so-called ghost phenomenon due to the memory effect of the toner is prevented from appearing on the produced image. More specifically, first and second electroconductive brushes are arranged around the photosensitive drum and provided with respective electric potentials, the first electroconductive brush being charged with an electric potential having the same polarity as that of the residual toner, the second electroconductive brush being charged with an electric potential having the polarity opposite to that of the residual toner, so that the residual toner may be absorbed by and discharged from the respective brushes and the toner and the photosensitive drum may be electrified or deelectrified to evenly distribute the residual toner on the surface of the drum and make the subsequently produced image free from any unrelated shade.

Japanese Patent Publication No. 4-83284 also discloses an image forming apparatus involving a cleanerless process and designed to eliminate any electric potential difference between the image carrying area and the non-image carrying area of the surface of the photosensitive drum of the apparatus.

However, if the photosensitive drum is provided with a corona charger, it inevitably generates ozone, which is not only harmful to the human body but is also liable to adversely affect the performance of the photosensitive drum particularly in terms of electric charge. Based on the fact that the ozone generation can be avoided by using a contact charging technique in place of corona charging, Japanese Patent Publication No. 4-310980 discloses the use of a contact charging technique in combination with a cleanerless process.

According to the above cited document, a photosensitive drum is provided with first and second brushes, of which the second one is an electrically charged brush and the first one is used to apply an electric potential having a polarity opposite to that of the second brush in order to remove any residual image existing on the drum after the image transferring step. In other words, the first brush is used to remove the memory of the drum and achieve an even distribution of the residual toner whereas the second brush is used to evenly charge the drum with electricity for the next exposure to light.

However, when a contact charging technique is used in combination with a cleanerless process, there arises a problem of adhesion of the residual toner to the charged brush in place of the phenomenon of a residual image produced by the residual toner. If the residual toner adheres generously to the charged brush, the performance of the brush of electrically charging the drum can become remarkably deteriorated.

It has been found that, if a negatively charged toner is used for developing an image, the residual toner adhering to the charged brush is positively charged.

For example, after printing a 100% blackening pattern on a hundred sheets one after another, the electrically charged brush 1 shown in FIG. 1 (that corresponds to the second brush of the arrangement described in the above Japanese Patent Publication No. 4-1310980) may be connected to a coulombmeter 2 to determine the electric charge of the toner adhering there.

On the other hand, the polarity of the residual toner remaining on the photosensitive drum 5 is determined to be positive by means of a coulombmeter 2 connected thereto in a manner as shown in FIG. 2 of the accompanying drawings to find out that the toner maintains the polarity from the developing step.

The degree of electric charge of the toner adhering to the charged brush 1 (FIG. 1) or that of the residual toner remaining on the photosensitive drum 5 (FIG. 2) may be determined by any known technique. For instance, the technique described in "A Technique of Determining the Electric Charge of a Component Toner, Using a Laser-Doppler Method"; "Japan Hardcopy 1991", pp. 29–32 (1991) may suitably be used.

FIG. 3 of the accompanying drawings shows the distribution pattern of the electric charge of the residual toner remaining on the photosensitive drum 5 typically observed after the transfer step. Referring to FIG. 3, the shaded area represents the distribution of the toner having the polarity opposite to that the charged brush 1, which is negative. Thus, the toner having the opposite polarity adheres to the electrically charged brush 1. The white area of the graph of FIG. 3 indicates that the residual toner remaining on the photosensitive drum is negatively charged.

On the other hand, the toner adhering to the electrically charged brush 1 of the arrangement of the above cited Japanese Patent Publication No. 4-83284 and having a polarity opposite to that of the brush 1 is thrown out from the brush to a large extent when the electric potential of the surface of the photosensitive drum fluctuates remarkably along the boundary of the non-image carrying area and the image carrying area to consequently fluctuate the electric field produced by the surface of the photosensitive drum and the electrically charged brush. However, the thrown out toner is not attracted by the developing vessel to give rise to a poorly performed cleaning operation and a residual image.

SUMMARY OF THE INVENTION

It is therefore an object of the present invention to provide an image forming apparatus that is free from the above identified problems and can effectively prevent the adhesion of the residual toner to the contact charging means of the apparatus, any possible degradation in the electrically charging performance of the contact charging means and the generation of residual images from taking place.

According to the invention, the above object is achieved by providing an image forming apparatus comprising:

contact charging means for charging an electrostatic latent image carrier while being kept in contact therewith; exposing means for exposing the electrostatic latent image carrier charged with electricity by said contact charging means to light and forming an electrostatic latent image thereon; developing means for visualizing the electrostatic latent electrostatic image formed on the electrostatic latent image carrier by the contact exposing means by means of coloring powder; transfer means for transferring an image visualized by the developing means onto a recording medium; deelectrifying means for deelectrifying the electrostatic latent image carrier after an image is transferred therefrom onto the recording medium; and coloring powder-charging means, arranged between the contact charging means and the transfer means, for charging the coloring powder, said coloring-powder charging means being in the form of a satin brush which is obtained by removing weft from conductive-fiber cloth.

With the above described arrangement of an image forming apparatus according to the invention, the residual coloring powder remaining on the electrostatic latent image carrier after transferring the image is charged with electricity to a polarity the same as that of the electric charge of the contact charging means charged by the coloring powder contact charging member. Thus, the residual coloring powder remaining on the electrostatic latent image carrier does not practically show a polarity opposite to that of the electric charge of the contact charging means so that the former would not adhere to the latter.

Additionally, since the coloring powder contact charging member is subjected to a voltage that does not affect the electric potential of the electrostatic latent image carrier at the image developing site and causes a difference between the electric potential of the coloring powder contact charging member and that of the electrostatic latent image carrier to become greater than the voltage for triggering an electric discharge between the coloring powder contact charging member and the electrostatic latent image carrier, the polarity of the electric charge of the coloring powder opposite to that of the electric charge of the electrostatic latent image carrier may be made the same as that of the electric charge of the contact charging means so that a developing operation and a cleaning operation may be carried out simultaneously at the image developing site.

Thus, an image forming apparatus according to the invention can effectively prevent the degradation in the electrically charging performance of the contact charging means and the generation of a residual image.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Now, a preferred embodiment of the invention will be described by referring to the accompanying drawings.

Figure 4:
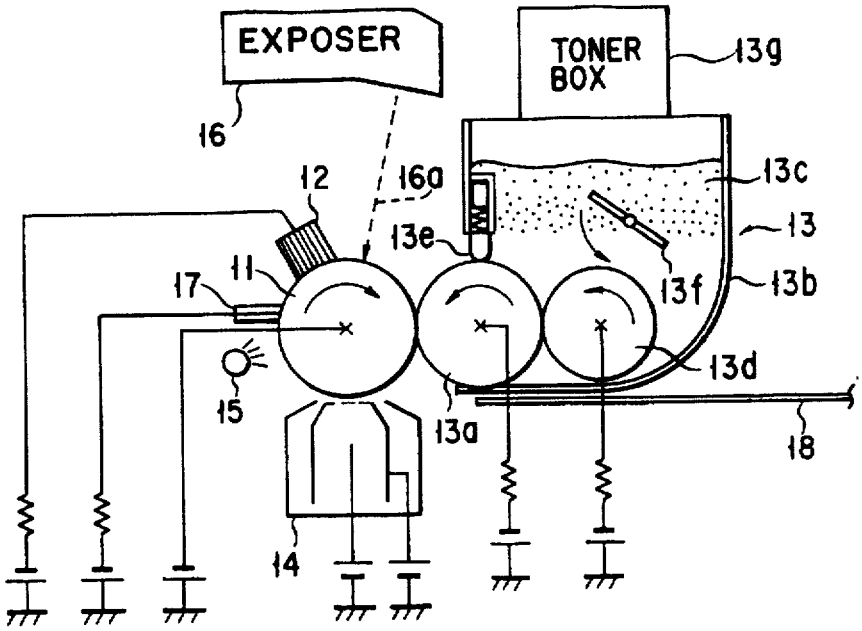
FIG. 4 is a schematic block diagram of a preferred embodiment of an image forming apparatus according to the invention, illustrating its configuration.

Referring firstly to FIG. 4, an embodiment of the invention comprises a photosensitive drum 11 that operates as an electrostatic latent image carrier and is driven to rotate clockwise as indicated by an arrow at a constant rate by means of a drive mechanism (not shown).

Otherwise, the embodiment comprises a contact charging means 12, a developing means 13, a transferring means 14 and a deelectrifying means 15 arranged clockwise from above around the photosensitive drum 11.

Additionally, an exposer 16 for exposure by light is arranged above the photosensitive drum 11 and a laser beam carrying data to be recorded is emitted from the exposer 16 onto a portion of the surface of the photosensitive drum 11 located between the contact charging means 12 and the developing means 13.

A coloring powder contact charging member 17 is arranged between said contact charging means 12 and said deelectrifying means 15.

Figure 5:
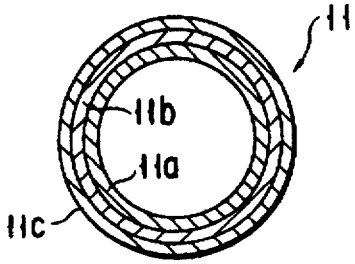
FIG. 5 is a schematic cross sectional view of a photosensitive drum that can be used for an image forming apparatus according to the invention.

Referring to FIG. 5, said photosensitive drum 11 is typically made of a hollow aluminum cylinder 11*a* having an outer diameter of 16 mm and a wall thickness of 0.8 mm and sequentially coated on the outer surface thereof with an electric charge generating layer 11*b* and an electric charge transporting layer 11*c*.

Said electric charge transporting layer 11*c* is adapted to transmit visible light and laser beams such as those emitted from semiconductor laser devices while the electric charge generating layer 11*b* is adapted to transmit light energy for exposure.

Figure 6:
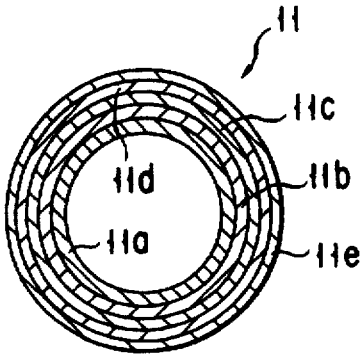
FIG. 6 is a schematic cross sectional view of another photosensitive drum that can be used for an image forming apparatus according to the invention.

A lower layer 11*d* may be arranged between the aluminum cylinder 11*a* and the electric charge generating layer 11*b* and the outer surface of the electric charge transporting layer 11*c* may be covered by a surface protection layer 11*e* as shown in FIG. 6.

Said contact charging means 12 is an electroconductive brush made of rayon, to which electroconductive carbon is added to make it effectively electroconductive. The rayon fibers preferably have a diameter between 1D and 10D (deniers) and are arranged to a concentration of 5,000 to 250,000 fibers/square inch. In the above embodiment, they have a diameter of 6D (deniers) and are arranged to a concentration of 100,00 fibers/square inch.

The specific electric resistance of the electroconductive fibers of the brush is preferably between $10^4$ Ω/cm and $10^8$ Ω/cm. In the above embodiment, it is equal to $10^5$ Ω/cm.

The electroconductive fibers of the brush may be processed for anti-inflammation in order to prevent them from burning when an excess electric current runs therethrough. Additionally, they may be processed for hydrophobicity in order to minimize the effect of changes in the environment, particularly in the ambient humidity.

Figure 7:
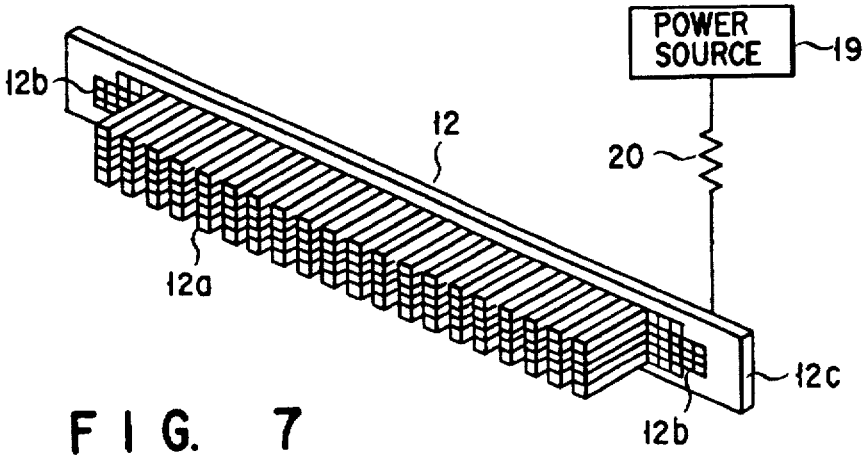
FIG. 7 is a schematic perspective view of the contact charging means of an image forming apparatus according to the invention.

As shown in FIG. 7, an electroconductive brush comprising fibers 12*a* of pile fabric may be used for the contact charging means 12 and carbon may be added to the opposite ends of the fibers 12*a* for electroconductivity. An electroconductive adhesive agent 12*b* is used between the metal base plate 12*c* and the fibers 12*a* of the brush in order to provide electroconductivity between them. For the purpose of the invention, a brush comprising fibers of pile fabric as illustrated in FIG. 32A of Japanese Patent Publication No. 64-20587 may suitably be used.

The electroconductive fibers 12 of the brush preferably touch the photosensitive drum 11 to a thickness of 0.2 mm to 3.0 mm. In the above embodiment, the depth of contact is adjusted to 1.0 mm.

For the purpose of the invention, the depth of contact is defined by the distance by which the front ends of the fibers of the brush can penetrate into the photosensitive drum from a state where they touch the photosensitive drum but are not pressed against it to a state where they are pressed against the photosensitive drum for alignment.

When the contact charging means 12 is placed in position, the line perpendicular to the center of the metal base plate 12*c* may pass through the center of the photosensitive drum 11 or a location downstream to the axis of the photosensitive drum 11. In the above embodiment, the line perpendicular to the center of the metal base plate 12*c* is displaced downstream from the axis of the photosensitive drum 11.

In FIG. 4, said exposer 16 for exposure by light typically comprises within a case a semiconductor laser oscillator, a deflector such as a polygonal mirror for deflecting the laser beam from the laser oscillator and scanning the surface of the photosensitive drum 11, a correcting lens for carrying out a variety of correcting operations including the correction of the curvature of the image forming surface of the laser beam deflected by the deflector for scanning, a number of reflectors for leading the laser beam to a desired spot and a detector for detecting the starting point of the scanning operation of the laser beam so that the photosensitive surface of the photosensitive drum 11 may be appropriately irradiated with the scanning laser beam 16*a* emitted from the aligner 16.

As shown in FIG. 4, said developing means 13 comprises a developing roller 13*a* held in contact with said photosensitive drum 11 for being rotated counter-clockwise as indicated by an arrow, a feeder roller 13*d* to be rotated clockwise as indicated by an arrow for feeding coloring powder (hereinafter referred to as toner) 13*c* contained in a hopper 13*b* to said developing roller 13*a*, a toner layer thickness controlling member 13*e* for controlling the rate at which the toner 13*c* is fed to the developing roller 13*a* in order to form a toner layer to a predetermined thickness, a stirring member 13*f* for stirring the toner 13*c* contained in the hopper 13*b* and a toner box 13*g* for feeding toner 13*c* to the hopper 13*b*.

A sheet of paper 18 is fed from paper feeding means (not shown) to an image transferring section between the photosensitive drum 11 and the transferring means 14 and, after an image is transferred onto it and thermally fixed in a thermal fixation unit (not shown), discharged from the apparatus.

The embodiment having an above described configuration operates in a manner as described below.

As it receives a print start signal from a host computer connected thereto, the photosensitive drum 11 is rotated clockwise and its surface is evenly charged with electricity by the contact charging means 12.

As dot image data is received from the host computer, the laser beam modulated by the dot image data is emitted from the semiconductor laser oscillator and deflected within the exposer means 16 to scan the electrically charged surface of the photosensitive drum 11. Thus, the surface of the photosensitive drum 11 is exposed to light by the exposer means 16 to form an electrostatic latent image there.

The electrostatic latent image formed there as a result of the exposure is then developed to a visible image as toner 13*c* is made to adhere to the surface of the photosensitive drum 11 by the developing roller 13*a* of the developing means 13. The visualized image is then transferred to the sheet of paper 18 by the transferring means 14 in the image transferring section.

The sheet of paper 18 now carrying the transferred image is then subjected to a thermal fixation process in the thermal fixation unit before it is discharged from the apparatus.

In the above embodiment, a reversal development process involving a negative polarity is adopted in order to simplify the process of electronic photography and the operation of cleaning the residual toner and that of developing an image are carried out simultaneously.

In the operation of developing an image with such an arrangement, the electric potential and the toner on the surface of the photosensitive drum 11 change in a manner as described below by referring to FIGS. 8*a* through 8D.

Figure 8A:
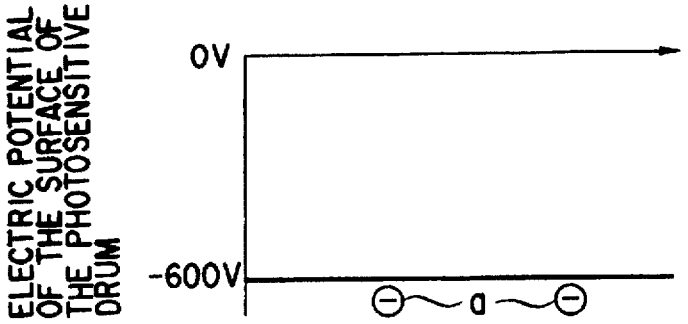
FIGS. 8A through 8D are schematic views, illustrating the reversal development process of the embodiment of the image the forming apparatus of FIG. 4.
Figure 8B:
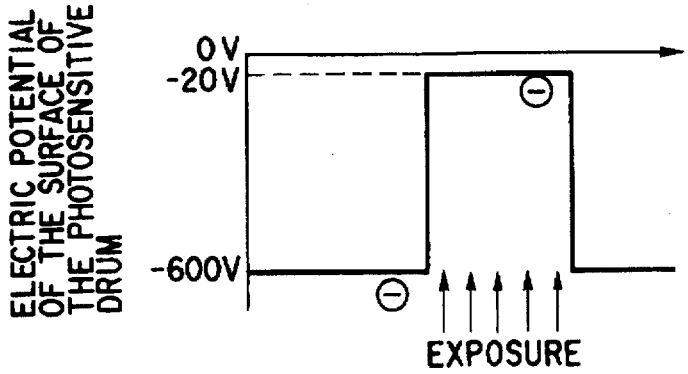

Firstly, in the electrically charging step, the surface of the photosensitive drum 11 is evenly charged with electricity to −600V by the contact charging means 12 as shown in FIG. 8A. Under this condition, the residual toner a that has not been transferred to the recording medium in the previous operation cycle is also charged with electricity along with the area of the surface of the photosensitive drum 11 covered by the residual toner a.

Then, in the exposing step, the surface of the photosensitive drum 11 is exposed to and scanned by the laser beam emitted from the exposer 16 for exposure to light so that the electric potential on the scanned area of the surface is forced to decline and an electrostatic latent image is formed there. The electric potential on the surface of the scanned area declines to −20V. Since the electric potential of the surface of the photosensitive drum 11 attenuates at a rate of 2.5 erg/cm$^2$ and three to four times greater than that rate is typically required for forming an electrostatic latent image, the intensity of the laser beam for scanning the surface of the photosensitive drum 11 is made equal to 10.0 erg/cm$^2$ for the above embodiment.

The formed electrostatic latent image is then developed by toner. Since the developing roller 13*a* is subjected to a developing bias voltage of −200V, this voltage is also applied to the toner 13*c* on the surface of the developing roller 13*a* before it touches the photosensitive drum 11.

Figure 8C:
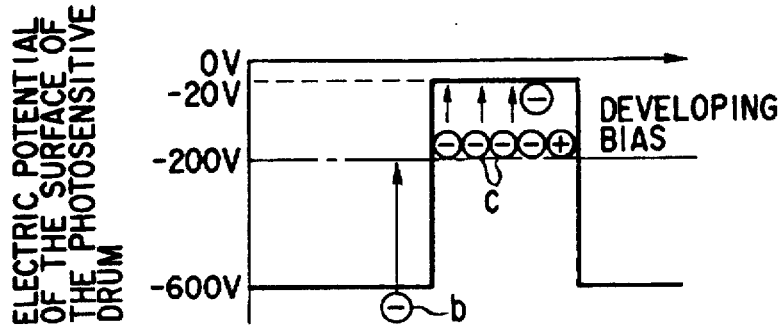

Therefore, in the developing step, the toner b of the unexposed area on the surface of the photosensitive drum 11 is made to adhere to the surface of the developing roller 13*a* by electrostatic force, while the toner c of the exposed area on the surface of the photosensitive drum 11 is made to move from the developing roller 13*a* and adhere to the surface of the photosensitive drum 11 by electrostatic force as shown in FIG. 8C.

Now, the toner b of the unexposed area on the surface of the photosensitive drum 11 is collected by the developing roller 13*a* and can be easily cleaned out.

Figure 8D:
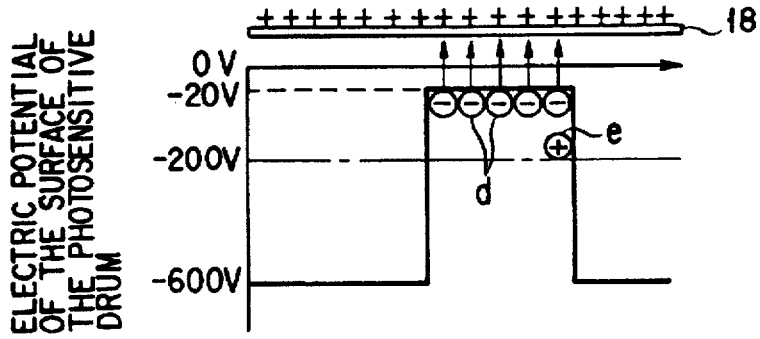

In the subsequent transferring step, the toner d on the surface of the photosensitive drum 11 is adsorbed by the electrically charged sheet of paper 18 as shown in FIG. 8D. The residual toner remaining on the photosensitive drum 11 is collected by the developing drum 13*a* in the developing step. Since the toner having an opposite polarity is not transferred, it is left on the surface of the photosensitive drum 11. The residual toner e having an opposite polarity of course shows a polarity opposite to that of the electrostatic brush of the contact charging means 12.

For such a reversal development process involving a negative polarity, the electric potential of the unexposed area on the surface of the photosensitive drum is preferably between −400 to −800V and actually equal to −600V in this embodiment so that a voltage of −1,100V is applied from a power source 19 to the metal base plate 12*c* of the contact charging means 12 by way of a protective resistor 20 for preventing any excess current from flowing. The resistance of the protective resistor 20 is preferably between 1MΩ and 200MΩ and a value of 10MΩ is selected for the above embodiment.

Since the developing means 13 is used to clean the photosensitive drum 11 in the above embodiment, paper dirt adhering to the photosensitive drum 11 can be taken up into the hopper 13*b*. However, any paper dirt adhering to the photosensitive drum 11 can be successfully removed by the coloring powder contact charging member 17.

A scorotron type discharger is used for the transferring means 14. A scorotron type discharger generates an electric charge at a rate lower than a corotron type discharger for transferring an image and hence operates relatively slowly for the process of electronic photography to the advantage of the present invention. While a scorotron type discharger generates an electric charge at a relatively low rate, the rate at which the electric charge is fed to the sheet of paper 18 can be controlled as a function of the electric charge of the sheet of paper 18. In other words, it is less subject to degradation in the image transferring performance.

Figure 9:
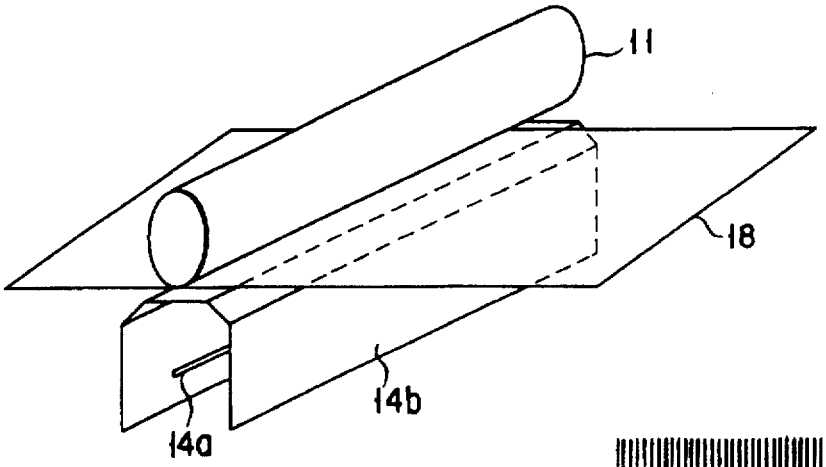
FIG. 9 is a schematic perspective view of the transferring means of the embodiment of the image forming apparatus of FIG. 4.
Figure 10:
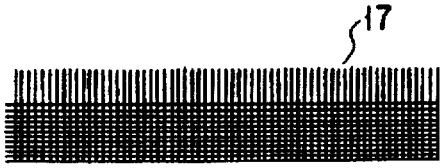
FIG. 10 is a schematic view of an electroconductive brush that can be used for the coloring powder contact charging member of an image forming apparatus according to the invention.

The transferring means 14 comprises a discharge wire 14*a* and a transferring grid 14*b* as shown in FIG. 9, of which the discharge wire 14*a* is preferably made of a gold plated tungsten wire having a diameter between 40 and 80 μm. A metal plated tungsten wire having a diameter of 60 μm is used for the above embodiment. The electric current to be made to flow through the discharge wire 14*a* is preferably between 100 and 500 μA and an electric current of 160 μA is used for the above embodiment.

The voltage to be applied to the transferring grid 14*b* is set to a level that optimizes the efficiency η of transferring the toner from the photosensitive drum 11 to the sheet of paper 18. The voltage to be applied to the contact charging grid 14*a* of the above embodiment is set to 700V. Since the rate at which ozone is generated by a corona discharger with the positive polarity is smaller than the rate of ozone generation of a comparable corona discharger with the negative polarity by a magnitude of a digit, the rate of ozone generation of the embodiment can be reduced by employing a scorotron type discharger with the positive polarity for the discharger.

The residual toner can be reduced to suppress the so-called memory phenomenon by using a polymerized toner that can be produced by a polymerization process. Since a polymerized toner can be controlled for particle size and also for the ingredients of each particle, it can produce a well defined distribution pattern of electric charge without significantly entailing the existence of oppositely charged toner.

As a result, the polarity of the polymerized toner can be shifted to reduce the ratio of the oppositely charged toner existing in the residual toner.

Figure 1:
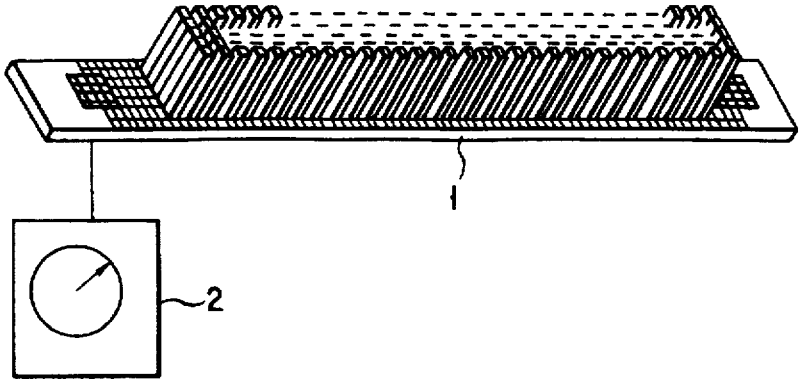
FIG. 1 (PRIOR ART)
FIG. 1 is a schematic illustration of an arrangement for detecting the existence of toner electrically charged to a polarity opposite to that of the electric charge of the photosensitive drum of a conventional image forming apparatus.
Figure 2:
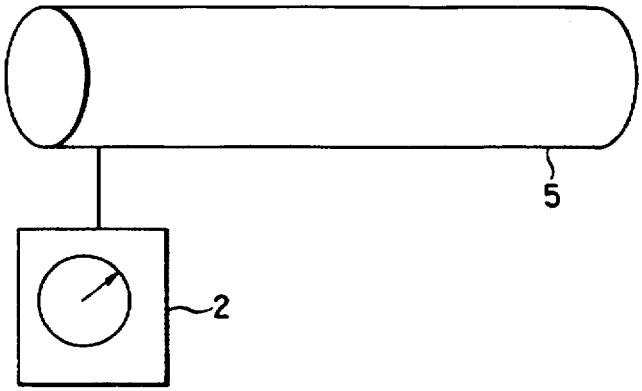
FIG. 2 (PRIOR ART)
FIG. 2 is a schematic illustration of an arrangement for detecting the polarity of the residual toner remaining on the photosensitive drum of a conventional image forming apparatus.
Figure 3:
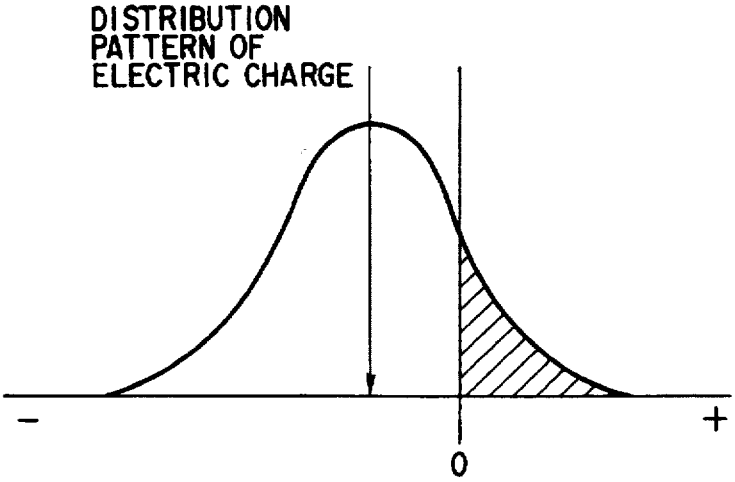
FIG. 3 (PRIOR ART)
FIG. 3 is a graph showing the distribution of the electric charge of the residual toner remaining on the photosensitive drum of a conventional image forming apparatus after the transferring step.

The coloring powder contact charging member 17 typically comprises an electroconductive roller, brush or a blade, although a brush is used in the above embodiment. The fibers of the brush preferably have a diameter between 1D and 10D (deniers), while fibers having a diameter of 6D (deniers) are used in the above embodiment. The specific resistance of the electroconductive fibers of the brush is set to a value equal to $10^5$ Ω·cm. The fibers may take the form of pile fabric as shown in FIG. 3 or that of satin fabric as illustrated in FIG. 7.

The coloring powder contact charging member 17 is required to have a property of being capable of charging the residual toner with electricity and that of not adversely affecting the electric potential of the surface of the photosensitive drum.

More specifically, the coloring powder contact charging member 17 is required to electrically charge the residual toner having an opposite polarity to reduce the residual toner. Generally, an electric charge injection mechanism with which an electric charge is moved through the interface of two objects and a discharge mechanism for moving an electric charge through a process of electric discharge are known for contact charging, although the discharge mechanism is predominant in contact charging.

For causing an electric discharge to take place, the difference between the electric potential of the coloring powder contact charging member 17 and that of the surface of the photosensitive drum 11 has to be made equal to or greater than the voltage for triggering an electric discharge between the coloring powder contact charging member and the photosensitive drum.

Figure 11:
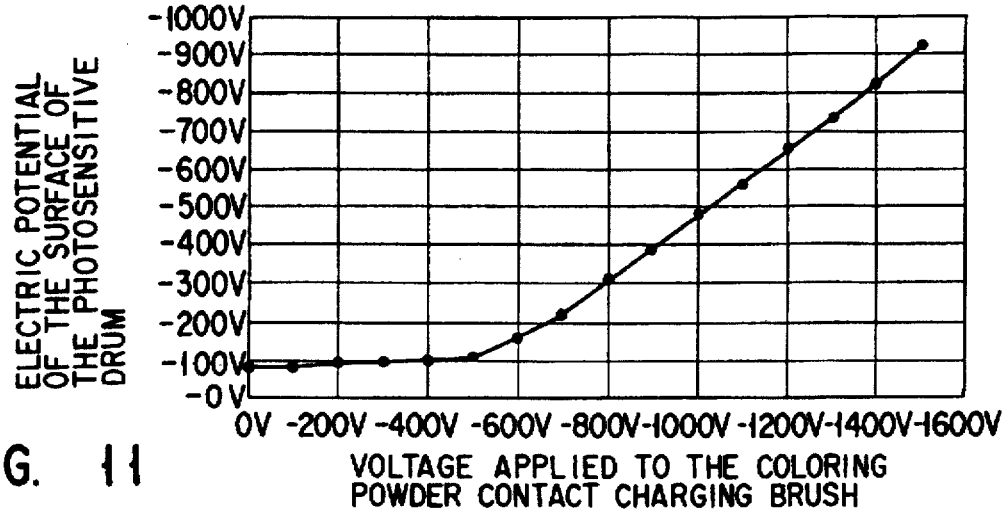
FIG. 11 is a graph showing the relationship between the voltage applied to the coloring powder contact charging member and the electric potential of the surface of the photosensitive drum of the embodiment of the image forming apparatus of FIG. 4.

FIG. 11 is a graph showing the relationship between the voltage applied to the coloring powder contact charging member and the electric potential of the surface of the photosensitive drum. It will be seen from the graph that the electric potential of the surface of the photosensitive drum 11 abruptly rises when the applied voltage exceeds −550V. In other words, the voltage for triggering an electric discharge is found somewhere around −550V because the discharge mechanism is predominant in contact charging.

Additionally, since the polarity of the toner having an opposite polarity and that of the coloring powder contact charging member 17 are opposite relative to each other, an electric charge can be moved easily and quickly between them.

The Table below shows a summary of the results of a series of experiments conducted to determine the total amount of consumed toner and the amount of toner adhering to the contact charging means 12 by printing a hundred sheets of paper to full black one after another, applying three different voltages of +500V, −500V and −1,000V to the coloring powder contact charging member 17.

The coloring powder contact charging member 17 was an electroconductive brush provided with satin fabric. The electroconductive brush used for the contact charging means 12 has a width of 5 mm relative to the sense of rotation of the photosensitive drum 11, whereas the electroconductive brush provided with satin fabric and used for the coloring powder contact charging member 17 has a width of about 1 mm relative to the sense of rotation of the photosensitive drum 11.

TABLE

| Voltage applied to coloring powder charged brush (coloring powder contact charging member 17) | Amount of toner adhering to charged brush (contact charging means 12) | Amount of consumed toner |
|---|---|---|
| +500 V | 0.10 g | 48.9 g |
| −500 V | 0.14 g | 48.8 g |
| −1,000 V | 0.03 g | 48.9 g |

As seen from the above Table, the amount of toner adhering to the contact charging means 12 could be reduced by applying −1,000V to the coloring powder contact charging member 17, giving a negative electric charge to the contact charging member 17 with a polarity equal to the negative polarity of the toner and causing an electric discharge to take place between the photosensitive drum 11 and the coloring powder contact charging member 17.

More specifically, as the difference between the electric potential of the surface of the coloring powder contact charging member 17 and that of the surface of the photosensitive drum 11 is made equal to or greater than the voltage for triggering an electric discharge, the negative charge generated by the discharge moves to the surface of the residual toner remaining on the surface of the photosensitive drum 11 to shift the electric charge distribution of the residual toner toward the negative side until no residual toner having a positive charge that can easily adhere to the negatively charged contact charging means 12 (as indicated by the shaded area of FIG. 3) remains there so that the possible adhesion of the residual toner to the contact charging means 12 is effectively inhibited.

On the other hand, when the coloring powder contact charging member 17 is used for contact charging, the absolute value of the potential of the surface of the photosensitive drum 11 increases. It is known that fog can be generated on the non-exposed area of the printed surface of the paper sheet if the absolute value of the potential of the surface of the photosensitive drum. The fog phenomenon is described in detail in U.S. Pat. No. 4,616,918.

In view of the above fact, it is not desirable to significantly change the electric potential of the surface of the photosensitive drum 11 by means of the coloring powder contact charging member 17. Therefore, the use of an electroconductive brush provided with satin fabric is most recommended in order to reduce the contact area of the photosensitive drum 11 and the coloring powder contact charging member 17 and consequently prevent the electric potential of the surface of the photosensitive drum 11 from fluctuating.

Figure 12:
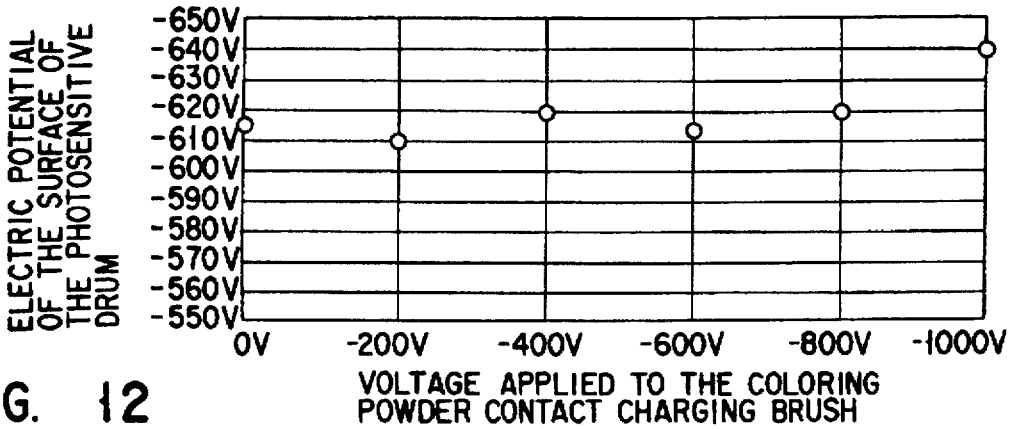
FIG. 12 is a graph showing the relationship between the voltage applied to the coloring powder contact charging member and the electric potential of the surface of the photosensitive drum at the developing site of the embodiment of the image forming apparatus of FIG. 4.

FIG. 12 is a graph showing the relationship between the voltage applied to the coloring powder contact charging member 17 and the electric potential of the surface of the photosensitive drum 11 at the developing site after charging it with electricity by the contact charging means 12. Particularly, it was found that the electric potential of the surface of the photosensitive drum 11 changes remarkably when a voltage of −1,000V is applied to the coloring powder contact charging member 17, whereas no significant change was observed on the electric potential of the surface of the photosensitive drum 11 when a voltage of −800V was applied to the coloring powder contact charging member 17.

Thus, it was confirmed that a voltage between −550 and −800V that is greater than the voltage for triggering an electric discharge between the coloring powder contact charging member 17 and the photosensitive drum 11 is preferably applied to the coloring powder contact charging member 17 in order to prevent the electric potential of the surface of the photosensitive drum 11 from fluctuating.

While the polarity of the toner and that of the photosensitive drum are described above in terms of negative (−) polarity, they may alternatively be expressed in terms of positive polarity (+). Then, the voltage for triggering an electric discharge will be between +550 and +800V.

The concentration of fibers of the coloring powder contact charging member 17 of the above embodiment along the axial direction of the photosensitive drum is 8,300 fibers/inch.

In an experiment, an electroconductive brush carrying thereon fibers of satin fabric to a concentration of 8,300 fibers/inch along the axial direction of the photosensitive drum was used and a voltage of −700V was applied to the member 17 to continuously print 10,000 paper sheets on a one by one basis with a printing ratio of 5% and no abnormal electric charge due to the toner adhering to the contact charging means 12 was observed. In short, any possible degradation of the electrically charging performance of the contact charging means 12 due to the toner adhering thereto can be effectively avoided and no memory phenomenon was observed. The applied voltage of −700V was an optimal value obtained to meet the requirements of not significantly changing the electric potential of the surface of the photosensitive drum and of effectively preventing the residual toner from adhering to the contact charging means 12.

While the present invention is described above in terms of a process of negatively charged electronic photography, it may be equally applicable to a process of positively charged electronic photography.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

contact charging means for electrically charging an electrostatic latent image carrier while being kept in contact with the electrostatic latent image carrier;

exposing means for exposing said electrostatic latent image carrier charged with electricity by said contact charging means to light and forming an electrostatic latent image thereon;

developing means for visualizing the electrostatic latent image formed on the electrostatic latent image carrier by the exposing means by means of coloring powder;

transfer means for transferring an image formed by the developing means onto a recording medium;

deelectrifying means for deelectrifying the electrostatic latent image carrier after an image is transferred therefrom onto the recording medium; and coloring powder-charging means, arranged between the contact charging means and the transfer means, for charging the coloring powder, said coloring powder-charging means comprising a satin brush which is obtained by removing weft from conductive-fiber cloth;

wherein said coloring powder charging means has a same polarity as toner, and is applied with a voltage higher than a discharge-triggering voltage.

2. An image forming apparatus according to claim 1, wherein the voltage is applied between said coloring powder-charging means and said electrostatic latent image carrier, which voltage is between −550 and −800V.

3. An image forming apparatus according to claim 1, wherein the voltage is applied between said coloring powder-charging means and said electrostatic latent image carrier, which voltage is between +550 and +800V.

4. An image forming apparatus according to claim 1, wherein said satin brush is an electroconductive brush comprising electroconductive fibers, each electroconductive fiber having a diameter between 1 and 10 deniers and a specific resistance of $10^5$ Ω·cm.

5. An image forming apparatus according to ciaim 4, wherein said electroconductive brush comprises said electroconductive fibers woven to a satin fabric to a concentration of 8,300 fibers/inch along an axial direction of said electrostatic latent image carrier.

6. An image forming apparatus according to claim 1, wherein said contact charging means comprises an electroconductive brush comprising electroconductive fibers, each electroconductive fiber having a diameter between 1 and 10 deniers and a specific resistance between $10^4$ Ω/cm and $10^8$ Ω/cm, and wherein said electroconductive fibers are arranged to a concentration between 5,000 and 25,000 fibers/inch$^2$.

7. An image forming apparatus according to claim 1, wherein said transfer means comprises a scorotron discharger.

8. An image forming apparatus according to claim 1, wherein said satin brush is an electroconductive brush comprising electroconductive fibers woven to the satin cloth.

9. An image forming apparatus comprising:

contact charging means for charging the electrostatic latent image carrier while being kept in contact with the electrostatic latent image carrier;

exposing means for exposing the electrostatic latent image carrier charged with electricity by said contact charging means to light and forming an electrostatic latent image thereon;

developing means for visualizing the electrostatic latent image formed on the electrostatic latent image carrier by the exposing means by means of coloring powder;

transfer means for transferring an image formed by the developing means onto a recording medium;

deelectrifying means for deelectrifying the electrostatic latent image carrier after an image is transferred therefrom onto the recording medium; and coloring powder-charging means, arranged between the contact charging means and the transfer means, and comprising a brush formed of conductive fibers; and voltage application means for applying the coloring powder-charging means with a voltage which makes the coloring powder-charging means equal in polarity to toner and which voltage is higher than a discharge-triggering voltage, and wherein said coloring powder is polymerized toner produced by a polymerization process.

10. An image forming apparatus according to claim 9, wherein said voltage application means applies a voltage of between −550 and −800V to the coloring powder-charging means.

11. An image forming apparatus according to claim 9, wherein said voltage application means applies a voltage of between +550 and +800V to the coloring powder-charging means.

12. An image forming apparatus according to claim 9, wherein said brush is an electroconductive brush comprising electroconductive fibers, each electroconductive fiber having a diameter between 1 and 10 deniers and a specific resistance of $10^5$ Ω·cm.

13. An image forming apparatus according to claim 9, wherein said brush comprises electroconductive fibers woven to a satin fabric to a concentration of 8,300 fibers/inch along an axial direction of said electrostatic latent image carrier.

14. An image forming apparatus according to claim 9, wherein said contact charging means comprises an electroconductive brush comprising electroconductive fibers, each electroconductive fiber having a diameter between 1 and 10 deniers and a specific resistance between $10^4$ Ω/cm and $10^8$ Ω/cm, and wherein said electroconductive fibers are arranged to a concentration between 5,000 and 25,000 fibers/inch$^2$.

15. An image forming apparatus according to claim 9, wherein said transfer means comprises a scorotron discharger.

* * * * *